US008999145B2

(12) United States Patent
Bauer et al.

(10) Patent No.: US 8,999,145 B2
(45) Date of Patent: Apr. 7, 2015

(54) SLURRY HYDROCRACKING PROCESS

(71) Applicant: UOP LLC, Des Plaines, IL (US)

(72) Inventors: Lorenz J. Bauer, Schaumburg, IL (US); Maureen L. Bricker, Buffalo Grove, IL (US); Beckay J. Mezza, Arlington Heights, IL (US); Alakananda Bhattacharyya, Glen Ellyn, IL (US)

(73) Assignee: UOP LLC, Des Plaines, IL (US)

( * ) Notice: Subject to any disclaimer, the term of this patent is extended or adjusted under 35 U.S.C. 154(b) by 151 days.

(21) Appl. No.: 13/652,439

(22) Filed: Oct. 15, 2012

(65) Prior Publication Data

US 2014/0102944 A1 Apr. 17, 2014

(51) Int. Cl.
*C10G 47/02* (2006.01)
*C10G 47/04* (2006.01)

(52) U.S. Cl.
CPC ..... *C10G 47/02* (2013.01); *C10G 47/04* (2013.01)

(58) Field of Classification Search
USPC ..... 502/325–326, 328, 336, 338
See application file for complete search history.

(56) References Cited

U.S. PATENT DOCUMENTS

| | | | |
|---|---|---|---|
| 3,905,916 | A | 9/1975 | Riley et al. |
| 4,091,071 | A | 5/1978 | Boros et al. |
| 4,120,780 | A | 10/1978 | Morimoto et al. |
| 4,300,015 | A | 11/1981 | Kirsch et al. |
| 4,434,044 | A | 2/1984 | Busch et al. |
| 4,559,130 | A | 12/1985 | Reynolds et al. |
| 4,560,465 | A | 12/1985 | Yu et al. |
| 4,655,903 | A | 4/1987 | Rahbe et al. |
| 4,676,886 | A | 6/1987 | Rahbe et al. |
| 4,751,210 | A | 6/1988 | de Agudelo et al. |
| 4,851,107 | A | 7/1989 | Kretschmar et al. |
| 4,894,141 | A | 1/1990 | Busch et al. |
| 4,941,966 | A | 7/1990 | Merz et al. |
| 4,948,773 | A | 8/1990 | Ito |
| 5,021,144 | A | 6/1991 | Altrichter |
| 5,064,523 | A | 11/1991 | Kretschmar et al. |
| 5,166,118 | A | 11/1992 | Kretschmar et al. |
| 5,178,749 | A | 1/1993 | Lopez et al. |
| 5,374,348 | A | 12/1994 | Sears et al. |
| 5,474,977 | A | 12/1995 | Gatsis |
| 5,755,955 | A | 5/1998 | Benham et al. |

(Continued)

FOREIGN PATENT DOCUMENTS

| | | | |
|---|---|---|---|
| JP | 62041287 | A2 | 2/1987 |
| SU | 621312 | A3 | 8/1978 |

(Continued)

OTHER PUBLICATIONS

Speight, J.G. (1999). The Chemistry and Technology of Petroleum, 3rd ed., Marcel-Dekker, 918 pgs.*

(Continued)

*Primary Examiner* — Brian McCaig

(57) ABSTRACT

One exemplary embodiment can be a slurry hydrocracking process. The process can include providing one or more hydrocarbon compounds having an initial boiling point temperature of at least about 340° C., and a slurry catalyst to a slurry hydrocracking zone. The slurry catalyst may have about 32-about 50%, by weight, iron; about 3-about 14%, by weight, aluminum; no more than about 10%, by weight, sodium; and about 2-about 10%, by weight, calcium. Typically, all catalytic component percentages are as metal and based on the weight of the dried slurry catalyst.

20 Claims, 1 Drawing Sheet

(56) References Cited

U.S. PATENT DOCUMENTS

| | | | | |
|---|---|---|---|---|
| 5,866,501 | A | 2/1999 | Pradhan et al. | |
| 6,174,430 | B1 | 1/2001 | Winquist et al. | |
| 6,248,302 | B1 * | 6/2001 | Barnett et al. | 423/83 |
| 6,274,530 | B1 | 8/2001 | Cayton et al. | |
| 6,403,526 | B1 | 6/2002 | Lussier et al. | |
| 6,455,462 | B2 | 9/2002 | Van Berge et al. | |
| 6,660,157 | B2 | 12/2003 | Que et al. | |
| 7,732,537 | B2 | 6/2010 | Chang et al. | |
| 7,749,374 | B2 | 7/2010 | Bhan et al. | |
| 7,803,266 | B2 | 9/2010 | Guillaume et al. | |
| 7,820,135 | B2 | 10/2010 | Bhattacharyya et al. | |
| 8,021,538 | B2 | 9/2011 | Klein | |
| 2009/0321315 | A1 | 12/2009 | Bhattacharyya et al. | |
| 2009/0326303 | A1 | 12/2009 | Bhattacharyya et al. | |
| 2010/0326883 | A1 | 12/2010 | Van Wees et al. | |
| 2011/0303580 | A1 | 12/2011 | Haizmann | |
| 2012/0065056 | A1 | 3/2012 | Domokos et al. | |
| 2012/0085680 | A1 | 4/2012 | Mezza et al. | |

FOREIGN PATENT DOCUMENTS

| | | |
|---|---|---|
| WO | 2006032989 | 3/2006 |
| WO | 2008056130 | 5/2008 |

OTHER PUBLICATIONS

Kurdowski, W. et al. (1997). "Red Mud and Phosphogypsum and Their Fields of Application," in Waste Materials Used in Concrete Manufacturing, ed. by C. Sadish, William Andrew, pp. 290-319.*

Butz, "Hydrocracking of Arabian Mix Asphaltenes in the Presence of Modified Red Mud", Fuel Science & Technology International, Oct. 1996, vol. 14, No. 9, pp. 1219-1236.

Kaiser Aluminum & Chemical Corporation, "Cajunite", Cajunite Registration, Aug. 20, 1996, 5 pages.

Mortenson, "Control of Particulate Emissions From a Fluid Cat Cracker in Los Angeles", American Petroleum Institute Proceedings; Division of Refining 1972, May 1972, Number Prepr N. 38-72, 9-13, pp. 540-543.

Abstract of Nakata et al., "Hydrodemetallization of Residual Oils with Red Mud Catalyst", Sekiyu Gakkai Shi, Mar. 1976, vol. 19, No. 3, 1 Page.

Nelson, "Composition of Liquid Products from Catalytic Hydrotreatment of Flash Pyrolysis Tars: 2. Slurry-Phase Reactor Products", Fuel, Jan. 1988, vol. 67, No. 1, pp. 94-97.

Abstract of Sourkouni-Argirusi, "Red-Mud Based Catalytic Additives for Hydrocracking-1. Preparation and Basic Tests", Erdoel and Kohle—Erdgas—Petrochemie vereinigt mit Brennstoff-Chemie, Oct. 1994, vol. 47, No. 10, 1 Page.

Sushil et al., "Catalytic Applications of Red Mud, an Aluminum Industry Waste: A Review", Applied Catalysis B: Environmental, May 30, 2008, vol. 81, No. 1-2, pp. 64-77.

Zhang, "A Review of Slurry-Phase Hydrocracking Heavy Oil Technology", Energy & Fuels, vol. 21, No. 6, 2007, p. 3057-3062.

Search Report dated Dec. 19, 2013 for corresponding PCT Appl. No. PCT/US2013/059428.

* cited by examiner

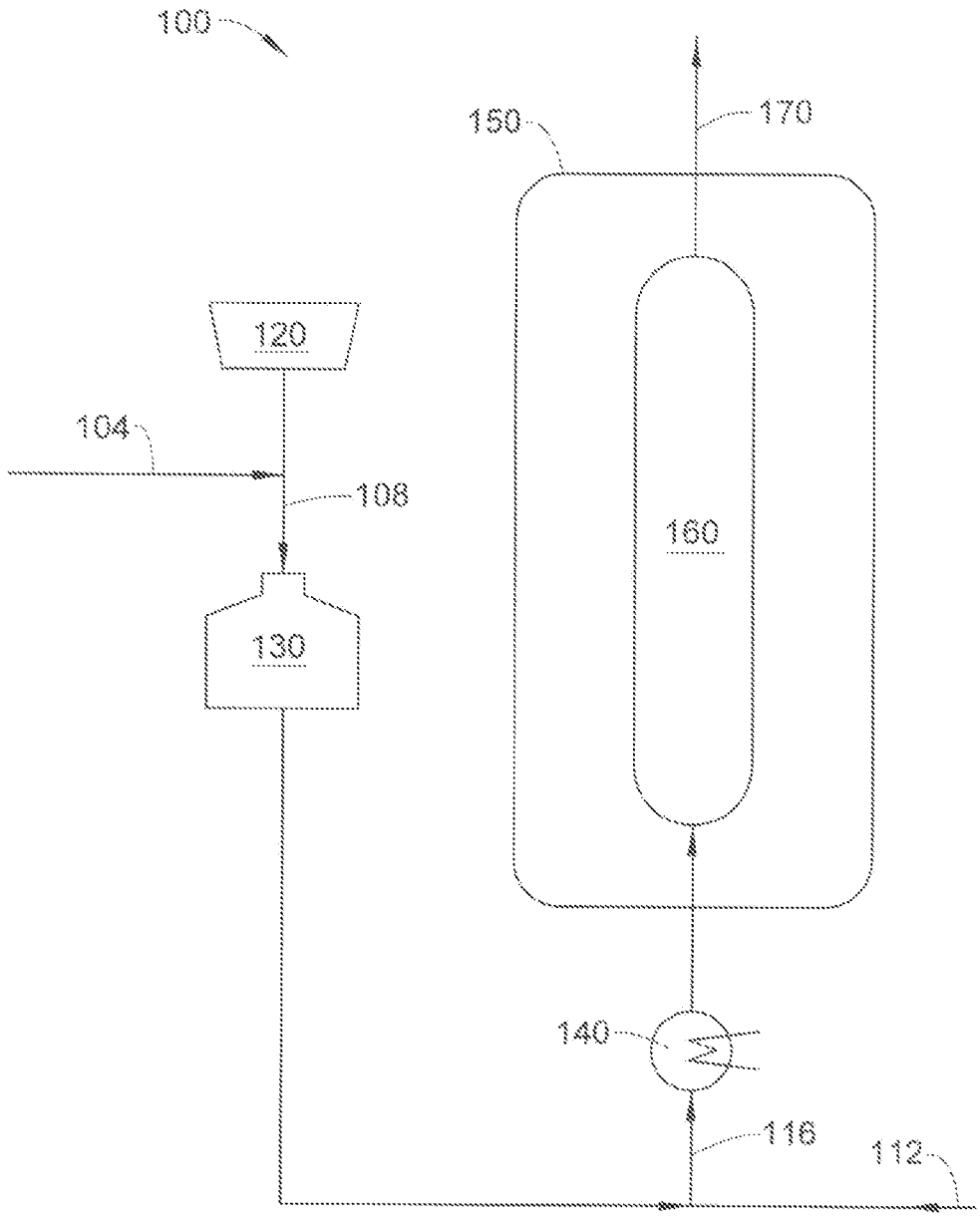
100
150
170
120
104
108
160
130
140
116
112

SLURRY HYDROCRACKING PROCESS

FIELD OF THE INVENTION

This invention generally relates to a slurry hydrocracking process.

DESCRIPTION OF THE RELATED ART

Catalysts are often used in hydroconversion processes. In the hydroconversion of heavy oils, biofuels, and coal liquids, a catalytic slurry system typically is utilized with large amounts of catalyst.

Typically, these catalysts are relatively inexpensive and do not contain valuable metals, such as groups 8-10 metals. Generally, the catalyst is used in large quantities, and availability and cost are issues. Thus, finding another suitable source of inexpensive catalyst that can be available in large quantities is desired.

SUMMARY OF THE INVENTION

One exemplary embodiment can be a slurry hydrocracking process. The process can include providing one or more hydrocarbon compounds having an initial boiling point temperature of at least about 340° C., and a slurry catalyst to a slurry hydrocracking zone. The slurry catalyst may have about 32-about 50%, by weight, iron; about 3-about 14%, by weight, aluminum; no more than about 10%, by weight, sodium; and about 2-about 10%, by weight, calcium. Typically, all catalytic component percentages are as metal and based on the weight of the dried slurry catalyst.

Another exemplary embodiment can be a slurry hydrocracking process. The process may include providing one or more hydrocarbon compounds having an initial boiling point temperature of at least about 340° C., and a slurry catalyst to a slurry hydrocracking zone. Usually, the slurry catalyst includes about 15-about 25%, by weight, iron; about 1.5-about 7%, by weight, aluminum; no more than about 5%, by weight, sodium; and greater than about 1-about 5%, by weight, calcium. Typically, all catalytic component percentages are as metal and based on the weight of the slurry catalyst with a loss on ignition at 900° C. of about 40-about 60%, by weight.

A further exemplary embodiment can be a slurry hydrocracking process. The process may include providing one or more hydrocarbon compounds having an initial boiling point temperature of at least about 340° C., and a slurry catalyst to a slurry hydrocracking zone. Typically, the slurry catalyst includes about 46-about 72%, by weight, iron oxide; about 6-about 27%, by weight, aluminum oxide; no more than about 14%, by weight, sodium oxide; and about 3-about 14%, by weight, calcium oxide. Typically, all catalytic component percentages are as oxide and based on the weight of the dried slurry catalyst.

The embodiments disclosed herein can provide a slurry hydrocracking catalyst minimizing low toluene insoluble organic residue, including mesophase. One potential benefit can provide a product with a lower weight of total solids, including material from the catalyst, in the product. Generally, the use of red mud as a catalyst is particularly beneficial as red mud currently has no commercial value and is often landfilled.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. The term "stream" may also include catalyst.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "substantially" can mean an amount of generally at least about 80%, preferably about 90%, and optimally about 99%, by weight, of a compound, class of compounds, or catalyst.

As used herein, the term "loss on ignition" may be abbreviated "LOI" and determined by UOP275-98 with inductively-coupled plasma (herein may be abbreviated "ICP") analysis. All components are provided in percent, by weight.

As used herein, the term "light vacuum gas oil" may hereinafter be abbreviated "LVGO" and can mean a hydrocarbon material boiling in a range of about 343-about 427° C.

As used herein, the term "heavy vacuum gas oil" may hereinafter be abbreviated "HVGO" and can mean a hydrocarbon material boiling in a range of about 427-about 524° C.

As used herein, the boiling temperatures can be the atmospheric equivalent boiling point as calculated from the observed boiling temperature and the distillation pressure, for example using the equations furnished in ASTM D1160-06.

As used herein, the term "dried slurry catalyst" can mean a slurry catalyst that has been dried to remove one or more liquids.

As used herein, the term "pitch" or "vacuum bottoms" can mean a hydrocarbon material boiling above about 524° C. and can include one or more $C40^+$ hydrocarbons.

As used herein, the term "kilopascal" may be abbreviated "KPa" and "megapascal" may be abbreviated "MPa", and all pressures disclosed herein are absolute.

As depicted, process flow lines in the figures can be referred to interchangeably as, e.g., lines, pipes, slurries, feeds, products, or streams.

BRIEF DESCRIPTION OF THE DRAWING

The FIGURE is a schematic depiction of an exemplary hydrocarbon conversion zone.

DETAILED DESCRIPTION

Referring to FIG. 1, one exemplary hydrocarbon conversion zone 100 can be a slurry reaction or bubble column system including a reservoir 120, a holding tank 130, a heater 140, and a hydroprocessing reaction zone 150. Exemplary systems are disclosed in, e.g., U.S. Pat. No. 5,755,955 and U.S. Pat. No. 5,474,977.

Typically, a hydrocarbon feed 104 can be provided, which may be a light vacuum gas oil, a heavy vacuum gas oil, a vacuum residue, a fluid catalytic cracking slurry oil, a pitch, or other heavy hydrocarbon-derived oils. Alternatively, the hydrocarbon feed 104 can be at least one of coal liquid or a biofuel feedstock such as lignin, one or more plant parts, one or more fruits, one or more vegetables, a plant processing waste, one or more woodchips, chaff, one or more grains, one or more grasses, a corn, one or more corn husks, one or more weeds, one or more aquatic plants, hay, paper, and any cellulose-containing biological material. The hydrocarbon feed 104 can include one or more hydrocarbon compounds having an initial boiling point temperature of at least about 340° C.

A reservoir 120 can provide a catalyst to be combined with the hydrocarbon feed 104. A resultant slurry 108, i.e., a combination of the catalyst and the hydrocarbon feed 104 having a solids content of about 0.01-about 10%, by weight, can pass to a holding tank 130 before being combined with a gas 112. Usually, the slurry catalyst has an average particle size of no more than about 75 microns, or of about 10-about 75 microns. The catalyst can include red mud, which can be a waste stream from a bauxite process.

Typically, red mud is generated as a waste during the processing of bauxite, the most common ore of aluminum used in the process. The ore can be washed, ground and dissolved in sodium hydroxide under heat and pressure. The resulting products are sodium aluminate liquor, that may be further processed and a large quantity of undissolved solid waste called 'red mud' or 'bauxite waste'. Depending on the type/grade of ore used, the amount of red mud generated per ton of alumina produced may vary from about 0.3 tons for a high-grade ore to about 2.5 tons for a low-grade ore. Over 12 million tons can be produced annually at various sites around the world. Currently, there are limited uses and the majority is usually landfilled. Typically, the red mud is highly alkaline, but can be neutralized.

One preferred source is a spent bauxite product sold under the trade designation CAJUNITE by Kaiser Aluminum and Chemical Corporation. Kaiser Aluminum and Chemical Corporation has disclosed the red mud to be used for engineered earthen products such as a synthetic landfill cover, road base, and levee construction material; agricultural soil enhancers, soil aggregates, and fertilizers; absorbents and solidification agents used for treating effluents; and fill used for reclamation.

Red mud can have a variety of compositions depending on the source. The main constituents of red mud can include iron oxide ($Fe_2O_3$), aluminum oxide ($Al_2O_3$), silicon oxide ($SiO_2$), titanium oxide ($TiO_2$), sodium oxide ($Na_2O$), calcium oxide (CaO), and magnesium oxide (MgO) and optionally a number of minor constituents like potassium, chromium, vandium, nickel, copper, manganese, and zinc, and oxides thereof. Generally, iron oxide ($Fe_2O_3$) is the major constituent of red mud and gives the red mud a characteristic red brick color. However, some processes generate more hydrated material, such as a goethite (FeOOH) and iron (III) hydroxide ($Fe(OH)_3$). Metals can be present in reduced form, or as oxides, hydroxides, and/or oxide hydrates.

Red mud can include other mineralogical constituents, such as a hematite ($\alpha$-$Fe_2O_3$), an iron hydroxide ($Fe(OH)_3$), a magnetite ($Fe_3O_4$), a rutile ($TiO_2$), an anatase ($TiO_2$), a bayerite ($Al(OH)_3$), a halloysite ($Al_2Si_2O_5(OH)_4$), a boehmite (AlO(OH)), a diaspore (AlO(OH)), a gibbsite ($Al(OH)_3$), a kaolinite ($Al_2Si_2O_5(OH)_4$), a quartz ($SiO_2$), a calcite ($CaCO_3$), a perovskite ($CaTiO_3$), a sodalite ($Na_4Al_3Si_3O_{12}Cl$), a cancrinite ($Na_6Ca_2[(CO_3)_2|Al_6Si_6O_{24}].H_2O$), a whewellite ($CaC_2O_4.H_2O$), a katoite ($Ca_3Al_2(SiO_4)_{1.5}(OH)_6$), and a gypsum ($CaSO_4.2H_2O$).

One exemplary red mud can include the following components:

TABLE 1

| Metal | General Range (Weight Percent) | Preferred Range (Weight Percent) | Optimal Range (Weight Percent) |
|---|---|---|---|
| Iron | 32-50 | 40-50 | 45-50 |
| Aluminum | 3-14 | 5-12 | 7-10 |
| Sodium | No More Than 10 | 1-10 | 4-8 |
| Calcium | 2-10 | 3-8 | 4-6 |
| Titanium | 1-10 | 1-4 | 2-4 |

All catalytic component percentages can be as metal and based on the weight of the dried slurry catalyst. As such, the dried slurry catalyst can include no more than about 1%, by weight, water. Alternatively, the dried slurry catalyst can have a loss on ignition at 900° C. of no more than about 0.01%, by weight. Furthermore, a washed slurry catalyst after drying can have a loss on ignition of no more than about 15%, preferably about 5-about 15%, and optimally about 12.3% at 900° C.

Another exemplary red mud can include the following components:

TABLE 2

| Metal | General Range (Weight Percent) | Preferred Range (Weight Percent) | Optimal Range (Weight Percent) |
|---|---|---|---|
| Iron | 15-25 | 20-25 | 22-25 |
| Aluminum | 1.5-7 | 2.5-6 | 3.5-5 |
| Sodium | No More Than 5 | 0.5-5 | 2-4 |
| Calcium | 1-5 | 2-5 | 2-3 |
| Titanium | 0.5-5 | 0.5-2 | 1-2 |

All catalytic component percentages can be as oxide and based on the weight of the wet slurry catalyst with a loss on ignition at 900° C. of about 50%. The wet slurry catalyst can have a loss on ignition at 900° C. of about 40-about 60%, preferably about 50%, by weight.

A further exemplary red mud may include the following components:

TABLE 3

| Metal Oxide | General Range (Weight Percent) | Preferred Range, (Weight Percent) | Optimal Range (Weight Percent) |
|---|---|---|---|
| Iron Oxide ($Fe_2O_3$) | 45-72 | 57-72 | 64-72 |
| Aluminum Oxide ($Al_2O_3$) | 5-27 | 9-23 | 13-19 |
| Sodium Oxide ($Na_2O$) | No More Than 14 | 1-14 | 5-11 |
| Calcium Oxide (CaO) | 2-14 | 4-12 | 5-9 |
| Titanium Oxide ($TiO_2$) | 1-17 | 1-7 | 3-7 |

All catalytic component percentages can be as oxide and based on the weight of the dried slurry catalyst. As such, the dried slurry catalyst can include no more than about 1%, by weight, water. Alternatively, the dried slurry catalyst can have a loss on ignition at 900° C. of no more than about 0.01%, by weight. Furthermore, a washed slurry catalyst after drying can have a loss on ignition of no more than about 15%, preferably about 5-about 15%, and optimally about 12.3% at 900° C.

Yet another exemplary red mud can include the following components:

TABLE 4

| Metal Oxide | General Range (Weight Percent) | Preferred Range (Weight Percent) | Optimal Range (Weight Percent) |
|---|---|---|---|
| Iron Oxide ($Fe_2O_3$) | 21-36 | 28-36 | 31-36 |
| Aluminum Oxide ($Al_2O_3$) | 2-13 | 4-12 | 6-10 |
| Sodium Oxide ($Na_2O$) | No More Than 7 | 0.5-7 | 2-6 |
| Calcium Oxide (CaO) | 1-7 | 2-7 | 2-5 |
| Titanium Oxide ($TiO_2$) | 1-9 | 1-4 | 2-4 |

All catalytic component percentages can be as oxide and based on the weight of the wet slurry catalyst with a loss on ignition at 900° C. of about 50%. The wet slurry catalyst can have a loss on ignition at 900° C. of about 40-about 60%, preferably about 50%, by weight.

The gas 112 typically contains hydrogen, which can be once-through hydrogen optionally with no significant amount of recycled gases. Alternatively, the gas 112 can contain recycled hydrogen gas optionally with added hydrogen as the hydrogen is consumed during the one or more hydroprocessing reactions. The gas 112 may be essentially pure hydrogen or may include additives such as hydrogen sulfide or light hydrocarbons, e.g., methane and ethane. Reactive or non-reactive gases may be combined with the hydrogen introduced into the hydroprocessing reaction zone 150 at the desired pressure to achieve the desired product yields.

A combined feed 116 including the slurry 108 and the gas 112 can enter the heater 140. Typically, the heater 140 is a heat exchanger using any suitable fluid such as the hydroprocessing reaction zone 150 effluent or high pressure steam to provide the requisite heating requirement. Afterwards, the heated combined feed 116 can enter the hydroprocessing reaction zone 150 including an upflow tubular reactor 160. Often, slurry hydroprocessing is carried out using reactor conditions sufficient to crack at least a portion of the hydrocarbon feed 104 to lower boiling products, such as one or more distillate hydrocarbons, naphtha, and/or C1-C4 products. Conditions in the hydroprocessing reaction zone 150 can include a temperature of about 340-about 600° C., a hydrogen partial pressure of about 3.5-about 10.5 MPa, and a space velocity of about 0.1-about 30 volumes of hydrocarbon feed 104 per hour per reactor or reaction zone volume. A reaction product 170 can exit the hydroprocessing reaction zone 150.

Generally, the iron present as iron oxide in the slurry hydrocracking catalyst may convert to iron sulfide, as disclosed in, e.g., U.S. Pat. No. 7,820,135, in the hydroprocessing reaction zone 150. Often, the iron oxide in the presence of alumina can quickly convert to active iron sulfide without presenting excess sulfur to the catalyst in the presence of a heavy hydrocarbon feed and hydrogen at high temperature.

The iron sulfide can have several molecular forms, so is generally represented by the formula, $Fe_xS$, where x can be 0.7-1.3. Although not wanting to be bound by theory, essentially all the iron oxide may convert to iron sulfide upon heating the mixture of hydrocarbon and catalyst to about 410° C. in the presence of hydrogen and sulfur. In this context, "essentially all" means no peak for iron oxide is generated on an XRD plot of intensity versus two theta degrees at 33.1 or no less than 99%, by weight, conversion to iron sulfide. Sulfur may be present in the hydrocarbon feed as organic sulfur compounds. Consequently, the iron in the catalyst may be added to the heavy hydrocarbon feed in the plus three oxidation state, preferably as $Fe_2O_3$. The catalyst may be added to the feed in the reaction zone or prior to entry into the reaction zone without pretreatment. After heating the mixture to reaction temperature, organic sulfur compounds in the feed may convert to hydrogen sulfide and sulfur-free hydrocarbons. The iron in the plus three oxidation state in the catalyst may quickly react at reaction temperature with hydrogen sulfide produced in the reaction zone by the reaction of organic sulfur and hydrogen. The reaction of iron oxide and hydrogen sulfide produce iron sulfide that may be the active form of the catalyst. Iron may then be present in the plus two oxidation state in the reactor.

The efficiency of conversion of iron oxide to iron sulfide can enable operation without adding sulfur to the feed if sufficient available sulfur is typically present in the feed to ensure complete conversion to iron sulfide. Because the iron oxide and alumina can be efficient in converting iron oxide to iron sulfide and in promoting the slurry hydrocracking reaction, less iron may be added to the slurry hydrocracking reactor. Consequently, less sulfur is typically required to convert the iron oxide to iron sulfide minimizing the need for sulfur addition. Generally, the iron oxide and alumina do not have to be subjected to elevated temperature in the presence of hydrogen to obtain conversion to iron sulfide. Conversion may also occur at below the slurry hydrocracking reaction temperature. By avoiding thermal and sulfiding pretreatments, process simplification and material cost reduction can be achieved. Additionally, less hydrogen may be required and less hydrogen sulfide and other sulfur can be removed from the slurry hydrocracking product.

Often, the iron content of catalyst as metal in the upflow tubular reactor 160 is typically about 0.1-about 4.0%, by weight, and usually no more than about 2.0%, by weight, of the catalyst and liquid in the upflow tubular reactor 160. Generally, iron content is the weight ratio of iron on the catalyst relative to the non-gas materials in the upflow tubular reactor 160. Typically, the non-gas materials in the upflow tubular reactor 160 are the hydrocarbon liquids, solids, and the catalyst; and do not include reactor and ancillary equipment.

Alternatively, pretreatments for enhancing performance to the red mud can be conducted, which may include an addition of a small amount of a promoter, mixing with a fly ash, a carbon, or one or more iron compounds, such as ferrous sulfate, and/or mixing with other mineral catalysts. Additionally, a thorough acid washing with sulfuric, phosphoric and/or hydrochloric acid can be conducted. Furthermore, presulfiding the red mud may also enhance performance and/or for low sulfur feeds if desired to convert all the iron oxide to iron sulfide. What is more, cations, such as calcium and sodium, can be removed and solids may be recovered by a post-reaction water-wash electrostatic separation.

The red mud catalyst as described herein can minimize coking. Typically, the red mud catalyst can perform similarly as other slurry hydrocracking catalyst, particularly with respect to toluene insoluble organic residue, which may include coke and mesophase, as described in, e.g., US 2012/0085680. Additionally, red mud often does not require grinding to blend with the feed. Usually, red mud is provided grounded and hence blending costs may be lowered. Moreover, less total catalyst is typically required because red mud often has a higher iron concentration as compared to other slurry hydrocracking catalyst on a dry basis.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A slurry hydrocracking process, comprising:

providing one or more hydrocarbon compounds having an initial boiling point temperature of at least about 340° C., and a slurry catalyst to a slurry hydrocracking zone, wherein the slurry catalyst comprises:

1) about 40-about 50%, by weight, iron;

2) about 3-about 14%, by weight, aluminum;

3) no more than about 10%, by weight, sodium; and 4) about 3-about 8%, by weight, calcium;

wherein all catalytic component percentages are as metal and based on the weight of a dried slurry catalyst.

2. The slurry hydrocracking process according to claim 1, wherein the slurry hydrocracking zone comprises an upflow tubular reactor.

3. The slurry hydrocracking process according to claim 1, wherein the iron, aluminum, sodium, and calcium are present as oxides, hydroxides, or oxide hydrates.

4. The slurry hydrocracking process according to claim 1, wherein the slurry catalyst comprises about 40-about 50%, by weight, iron as metal and based on the weight of the dried slurry catalyst.

5. The slurry hydrocracking process according to claim 1, wherein the dried slurry catalyst comprises no more than about 1%, by weight, water.

6. The slurry hydrocracking process according to claim 1, wherein the dried slurry catalyst has a loss on ignition at 900° C. of no more than about 0.01%, by weight.

7. The slurry hydrocracking process according to claim 1, wherein the one or more hydrocarbons comprises a light vacuum gas oil, a heavy vacuum gas oil, or a pitch.

8. The slurry hydrocracking process according to claim 1, wherein the slurry catalyst comprises a red mud.

9. The slurry hydrocracking process according to claim 1, wherein the slurry catalyst has an average particle size of no more than about 75 microns.

10. The slurry hydrocracking process according to claim 1, wherein the slurry catalyst comprises about 45-about 50%, by weight, iron as metal and based on the weight of the dried slurry catalyst.

11. A slurry hydrocracking process, comprising:

providing one or more hydrocarbon compounds having an initial boiling point temperature of at least about 340° C., and a slurry catalyst to a slurry hydrocracking zone, wherein the slurry catalyst comprises:

1) about 15-about 25%, by weight, iron;

2) about 3.5-about 5%, by weight, aluminum;

3) no more than about 5%, by weight, sodium; and 4) greater than about 3%, by weight, calcium;

wherein all catalytic component percentages are as metal and based on the weight of the slurry catalyst with a loss on ignition at 900° C. of about 40-about 60%, by weight.

12. The slurry hydrocracking process according to claim 11, wherein the slurry catalyst has a loss on ignition at 900° C. of about 50%, by weight.

13. The slurry hydrocracking process according to claim 11, wherein the slurry catalyst comprises about 2-about 5%, by weight, calcium and about 0.5-about 5%, by weight, titanium as metal based on the weight of the slurry catalyst.

14. The slurry hydrocracking process according to claim 11, wherein the slurry hydrocracking zone comprises an upflow tubular reactor.

15. The slurry hydrocracking process according to claim 11, wherein the iron, aluminum, sodium, and calcium are present as oxides, hydroxides, or oxide hydrates.

16. The slurry hydrocracking process according to claim 11, wherein the one or more hydrocarbons comprises a light vacuum gas oil, a heavy vacuum gas oil, or a pitch.

17. A slurry hydrocracking process, comprising:

providing one or more hydrocarbon compounds having an initial boiling point temperature of at least about 340° C., and a slurry catalyst to a slurry hydrocracking zone, wherein the slurry catalyst comprises:

1) about 57-about 72%, by weight, iron oxide;

2) about 6-about 27%, by weight, aluminum oxide;

3) no more than about 14%, by weight, sodium oxide; and 4) about 4-about 12%, by weight, calcium oxide;

wherein all catalytic component percentages are as oxide and based on the weight of a dried slurry catalyst.

18. The slurry hydrocracking process according to claim 17, wherein the dried slurry catalyst comprises no more than about 1%, by weight, water.

19. The slurry hydrocracking process according to claim 17, wherein the dried slurry catalyst has a loss on ignition at 900° C. of no more than about 0.01%, by weight.

20. The slurry hydrocracking process according to claim 17, wherein the slurry hydrocracking zone comprises an upflow tubular reactor.

* * * * *